US008985245B2

(12) United States Patent
Purcell

(10) Patent No.: US 8,985,245 B2
(45) Date of Patent: Mar. 24, 2015

(54) DRILL BIT ASSEMBLY FOR FLUID-OPERATED PERCUSSION DRILL TOOLS

(75) Inventor: Joseph Purcell, Clare (IE)

(73) Assignee: Mincon International, Shannon, Co. Clare (IE)

( * ) Notice: Subject to any disclaimer, the term of this patent is extended or adjusted under 35 U.S.C. 154(b) by 467 days.

(21) Appl. No.: 13/393,313

(22) PCT Filed: Aug. 31, 2010

(86) PCT No.: PCT/EP2010/062742

§ 371 (c)(1),
(2), (4) Date: Apr. 11, 2012

(87) PCT Pub. No.: WO2011/023829

PCT Pub. Date: Mar. 3, 2011

(65) Prior Publication Data

US 2012/0186883 A1 Jul. 26, 2012

(30) Foreign Application Priority Data

Aug. 31, 2009 (IE) ..... S2009/0659
Sep. 15, 2009 (IE) ..... S2009/0701

(51) Int. Cl.
*E21B 10/36* (2006.01)
*E21B 17/07* (2006.01)

(52) U.S. Cl.
CPC ..... *E21B 10/36* (2013.01); *E21B 17/076* (2013.01)
USPC ..... 175/415; 175/414; 175/417

(58) Field of Classification Search
CPC ..... E21B 1/00; E21B 10/36
USPC ..... 175/414, 415, 417, 327
See application file for complete search history.

(56) References Cited

U.S. PATENT DOCUMENTS

| | | | | |
|---|---|---|---|---|
| 5,803,192 | A | 9/1998 | Holte | 175/296 |
| 6,543,557 | B2 | 4/2003 | Gien | 175/296 |
| 7,117,939 | B1 | 10/2006 | Hawley et al. | 166/99 |
| 7,267,185 | B2 * | 9/2007 | Underwood et al. | 175/325.2 |
| 2007/0102196 | A1 | 5/2007 | Bassinger | 175/296 |

FOREIGN PATENT DOCUMENTS

| | | | |
|---|---|---|---|
| EP | 1 910 640 | 4/2008 | E21B 4/14 |
| WO | WO2007/077547 | 7/2007 | E21B 4/14 |
| WO | WO2009/023930 | 2/2009 | E21B 4/14 |

OTHER PUBLICATIONS

International Search Report for International Application No. PCT/EP2010/062742, Dec. 9, 2010.

* cited by examiner

*Primary Examiner* — Cathleen Hutchins
(74) *Attorney, Agent, or Firm* — Kusner & Jaffe

(57) ABSTRACT

The present invention relates to a drill bit assembly for fluid-operated percussion drill tools comprising a percussion bit (1) having a head portion (3) formed with an axially extending stub shank (32); axially extending splines (36) on the stub shank (32) slideably engageable with complementary splines (35) formed on a drive chuck (4) whereby rotational drive from the chuck (4) may be transmitted to the stub shank (32); bit retaining means adapted for engagement with complementary retaining means on the stub shank to retain the stub shank in the drill bit assembly; and engagement means on the chuck (4) adapted for connecting the chuck (4) to a drive means (5) of the fluid-operated percussion drill tool. The bit retaining means comprises a bit retaining ring (41), and the complementary retaining means comprises a retaining shoulder (37) on the stub shank, wherein the bit retaining ring is arranged to engage the retaining shoulder to retain the stub shank in the drill bit assembly. A portion (42) of the bit retaining ring (41) adapted to engage the retaining shoulder (37) to retain the stub shank (32) in the drill bit assembly is disposed within the chuck (4).

14 Claims, 17 Drawing Sheets

SECTION B-B

SECTION H-H

SECTION J–J

SECTION K-K

DRILL BIT ASSEMBLY FOR FLUID-OPERATED PERCUSSION DRILL TOOLS

FIELD OF THE INVENTION

The present invention relates to a drill bit assembly for fluid-operated percussion drill tools. In particular, the invention concerns a drill bit assembly for use with "down-the-hole" hammers.

BACKGROUND TO THE INVENTION

Some designs of conventional down-the-hole hammers and fluid-operated percussion drill tools comprise an external cylinder or outer wear sleeve, within which is mounted an inner cylinder which in turn engages with a backhead assembly. A sliding reciprocating piston co-operates with the inner cylinder and backhead assembly, which when air pressure is supplied through the backhead assembly, acts with a percussive effect on a drill bit retained within a chuck on the outer wear sleeve.

Typically the inner cylinder is mounted co-axially within the outer wear sleeve. A sliding piston is mounted for reciprocating movement within the inner cylinder and the outer wear sleeve, to strike a hammer bit mounted for sliding movement in a chuck located at the forward end of the outer wear sleeve, in well known manner. A foot valve is positioned above the bit.

Our prior patent application Publication No. WO 2004/031530, discloses a down-the-hole hammer in which the bit has an elongate shank portion which at its upper end has an annular strike face (or anvil) against which the piston impacts to impart a percussive force to the bit. A lower end of the bit shank is formed externally with a plurality of splines which are spaced around the circumference of the bit shank and extend in the axial direction. The splines slideably engage with complementary splines formed on the internal wall of an annular chuck. The chuck is screw-threadably connected to the bottom of the outer wear sleeve. The bit is retained in the hammer assembly by means of a bit retaining ring, which sits above the chuck and cooperates with an annular shoulder on the bit. This prevents the bit from falling out of the assembly in operation.

In operation the bit shank comes under forces due to the percussive action of the hammer, and rotational torque which is provided by the chuck. This imparts significant bending moments on the upper part of the bit shank increasing the risk of breakage of the shank due to cracking. Drill bits are very expensive to produce, and to recover if they are lost down the drilling hole. That this is a significant problem with the drill bits of conventional down-the-hole hammers is evidenced by the fact that there are a number of patents directed to means of retaining a broken-off bit within the bit assembly so as to prevent it falling down the drill hole. Examples of these patents are U.S. Pat. Nos. 5,065,827, 4,003,442, WO 96/15349, WO 98/05476, WO 03/062585, WO 03/062586. However, the inventions disclosed in these patents are directed to dealing with problems which occur after the bit shaft has fractured, and not to preventing the breakage in the first place.

Another disadvantage associated with conventional percussion drill tools, such as down-the-hole hammers, is that the bit has a long shank portion which is expensive to produce. The long shank portion is required in order to provide a splined shank portion of sufficient length to give enough support for transfer of rotational torque, and an area above the splines for retaining the bit. In conventional hammers, when the bit head or cutting face is worn out, the shank can often be in good condition but, because it is made integral with the cutting face, it must be discarded. The premature wearing out of the head/cutting face may occur where drilling is carried out in very abrasive rock or material which wears the tungsten carbide inserts in the cutting head. With many conventional hammers, there is a need to provide foot valves in the bit. The foot valve is required as an integral part of the functioning of the hammer i.e. when the piston is in the strike position, the bottom lift chamber is sealed by the bore of the piston and the outside of the footvalve. If this were not the case then the piston would not lift. The footvalve is prone to occasional breakage leading to down-time.

It is therefore desirable to provide a drill bit assembly for percussion drill tools, in which the length of the bit shank is substantially reduced in comparison to conventional percussion drill tools. However, when the bit is shortened in this way, retaining the bit within the chuck becomes more difficult. Traditional arrangements used for retaining long bit shanks in percussion drill tools, where a bit retaining ring sits above the chuck and cooperates with an annular shoulder on the bit, are not suitable for use with short stub shanks. This is because the maximum length of the drive chuck is limited by the length of the stub shank. As the chuck must include an upper screw thread portion for engagement with the outer wear sleeve, and a lower extension portion to protect the lower end of the outer wear sleeve from excessive wear, each of which must be sufficiently long to perform its intended purpose, it is desirable that the overall length of the chuck be maximised within the limit imposed by the shank length. It is therefore desirable to avoid an arrangement where a bit retaining ring must sit above the chuck, thereby further limiting the maximum length thereof.

Our granted European Patent No. 1 910 640 describes a drill bit assembly for fluid-operated percussion drill tools which overcomes a number of the problems discussed above. The assembly comprises a percussion bit having a head portion formed with an axially extending stub shank. The stub shank is provided with axially extending splines, which are slideably engageable with complementary splines formed on a drive chuck. Rotational drive from the chuck may be transmitted to the stub shank by means of the splines. Bit retaining means at the chuck are adapted for engagement with complementary retaining means at a spline portion of the stub shank to retain the stub shank in the drill bit assembly. Engagement means on the chuck are adapted for connecting the chuck to a drive means of the fluid-operated percussion drill tool.

This arrangement has a number of advantages over conventional systems. Because the means to retain the bit within the chuck has been moved to the splined portion of the stub shank, this assembly allows for a shortened shank and a maximised chuck length. In addition, splined support for transfer of rotational torque is provided both above and below the bit retaining means. Where the complementary retaining means comprises a plurality of recesses, each of which is formed entirely within one of the splines on the stub shank, splined support for transfer of rotational torque is provided over the entire length of the splines.

However, while useful for smaller assemblies, there are also a number of disadvantages associated with this arrangement. In particular, this assembly requires that one or more openings or slots be provided in the drive chuck. This can weaken the chuck and, in certain applications, may lead to breaking It is therefore desirable to provide an alternative means for retaining the stub shank in the drive chuck, which does not require slots or openings to be formed in the chuck but which does not require that the overall length of the chuck be reduced.

U.S. Pat. No. 6,543,557 relates to a down-the-hole drill hammer assembly including a long bit shank and a bit-retaining ring to retain the bit in the assembly when the bit drops out.

SUMMARY OF THE INVENTION

According to an aspect of the present invention, there is provided a drill bit assembly for fluid-operated percussion drill tools comprising:

a percussion bit having a head portion formed with an axially extending stub shank; axially extending splines on the stub shank slideably engageable with complementary splines formed on a drive chuck whereby rotational drive from the chuck may be transmitted to the stub shank; bit retaining means adapted for engagement with complementary retaining means on the stub shank to retain the stub shank in the drill bit assembly; and engagement means on the chuck adapted for connecting the chuck to a drive means of the fluid-operated percussion drill tool;

wherein the bit retaining means comprises a bit retaining ring, and the complementary retaining means comprises a retaining shoulder on the stub shank, wherein the bit retaining ring is arranged to engage the retaining shoulder to retain the stub shank in the drill bit assembly;

characterised in that a portion of the bit retaining ring adapted to engage the retaining shoulder to retain the stub shank in the drill bit assembly is disposed within the chuck.

There are a number of advantages associated with the arrangement described above. First of all, no slots or openings are required in the chuck in order to retain the bit within the assembly, and the disadvantages associated with providing these openings are thereby circumvented. Furthermore, because a portion of the bit retaining ring adapted to engage the retaining shoulder to retain the stub shank in the drill bit assembly is disposed within the chuck, the overall length of the chuck may be maximised, within the limits imposed by the stub shank. This allows the lengths of the engagement and extension portions of the chuck to be maximised and the ratio of the lengths of these portions to be balanced as required. The length of the bit retaining ring, and thus the point of retention of the stub shank, may be selected to provide the required ratio of the lengths of these portions.

Preferably, the drive chuck is formed with a screw thread which is adapted to engage with a complementary screw thread on the lower end of a wear sleeve of the drill tool. Suitably, the axially extending splines are formed on an external cylindrical wall of the stub shank and engage with complementary splines formed internally of the drive chuck.

Preferably, the bit retaining ring is substantially annular or cylindrical in shape.

In an embodiment, a lower portion of the bit retaining ring is disposed within the chuck. Suitably, the lower portion of the bit retaining ring disposed within the chuck is formed with an abutment which engages with the retaining shoulder on the stub shank to retain the stub shank in the drill bit assembly. Ideally, the abutment is an inwardly directed abutment. As mentioned above, the length of the bit retaining ring may be selected so that the point of retention of the bit is provided at an appropriate distance from the lower end of the chuck.

Suitably, the retaining shoulder is disposed within the chuck when the bit is in the extended position. The retaining shoulder may be provided at an upper end of the stub shank so that the upper end of the stub shank is disposed within the chuck when the bit is in the extended position.

In an embodiment, the bit retaining ring comprises a plurality of inwardly directed abutments around its circumference and the bit is provided with a corresponding plurality of retaining shoulders, wherein each abutment engages with a corresponding retaining shoulder on the stub shank to retain the stub shank in the drill bit assembly. In this embodiment, the retaining ring may be provided with means for engagement with a corresponding locating means provided on the chuck to prevent rotational movement of the retaining ring relative to the chuck. For example, the means may comprise a groove provided at an upper end of the retaining ring for engagement with a corresponding locating lug provided internally of the chuck to prevent rotational movement of the retaining ring relative to the chuck.

In an embodiment, the bit retaining ring may further comprise a shoulder for engagement with an upper end of the chuck. Ideally, the shoulder is an outwardly directed shoulder. In one embodiment, the shoulder is an outwardly directed abutment provided at an upper end of the retaining ring and disposed above the chuck to hold the retaining ring in place in the assembly.

In another embodiment, the shoulder is an outward taper arranged to engage with a (tapered) counterbore in the chuck to hold the bit retaining ring in place in the assembly. In this embodiment, the counterbore in the chuck and the taper on the bit retaining ring co-operate to ease insertion of the ring into the chuck, as the tapered counterbore has a wedging or swaging effect on the ring.

In one embodiment, both the outwardly directed abutment and the outward taper are provided to secure the ring in the assembly.

Suitably, the bit retaining ring may be formed as a plurality of segments for ease of assembly.

In another aspect, the invention provides a down-the-hole hammer comprising an external cylindrical outer wear sleeve, a sliding piston mounted for reciprocating movement within the outer wear sleeve to strike a percussion bit of a drill bit assembly located at the forward end of the outer wear sleeve, in which the drill bit assembly is as described above.

The hammer may be a conventional down-the-hole hammer or a reverse circulation down-the-hole hammer.

BRIEF DESCRIPTION OF THE DRAWINGS

Two embodiments of a down-the-hole hammer having a bit coupling system in accordance with the invention will now be described with reference to the accompanying drawings, wherein.

DETAILED DESCRIPTION OF THE DRAWINGS

Figure 1:
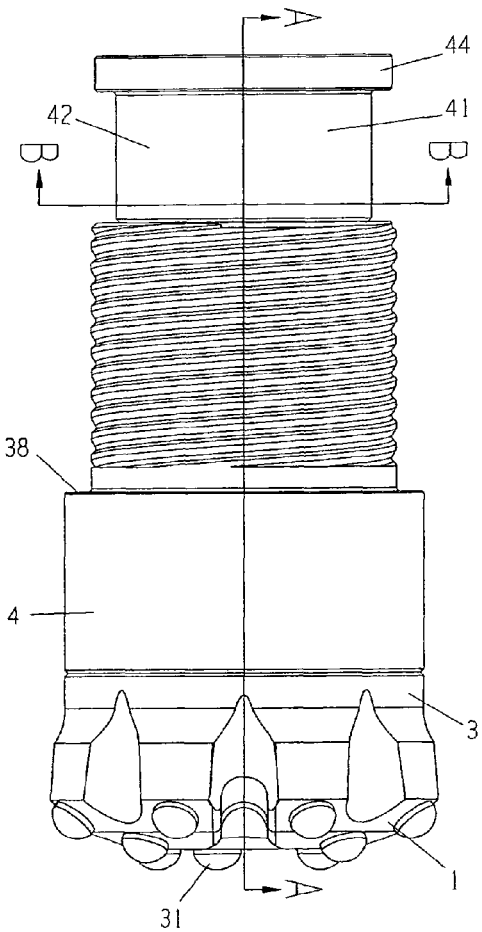
FIG. 1 is a side elevation of a drill bit assembly of a down-the-hole hammer according to a first embodiment of the invention, in a pre-assembled position.
Figure 2:
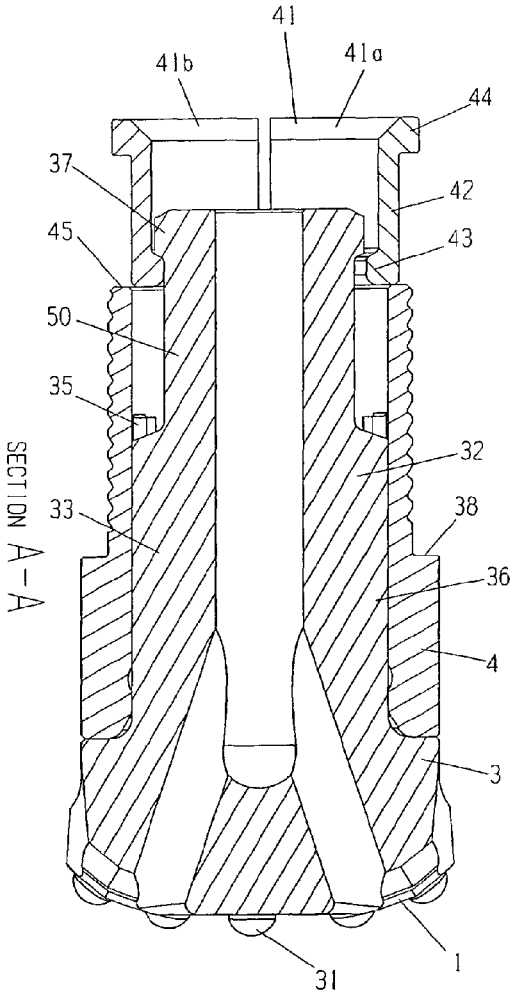
FIG. 2 is a sectional view of the drill bit assembly of FIG. 1, taken along line AA.
Figure 3:
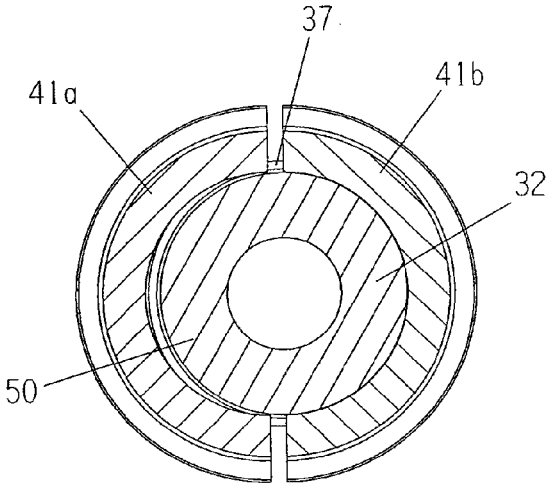
FIG. 3 is a sectional view of the drill bit assembly of FIG. 1, taken along line BB.
Figure 4:
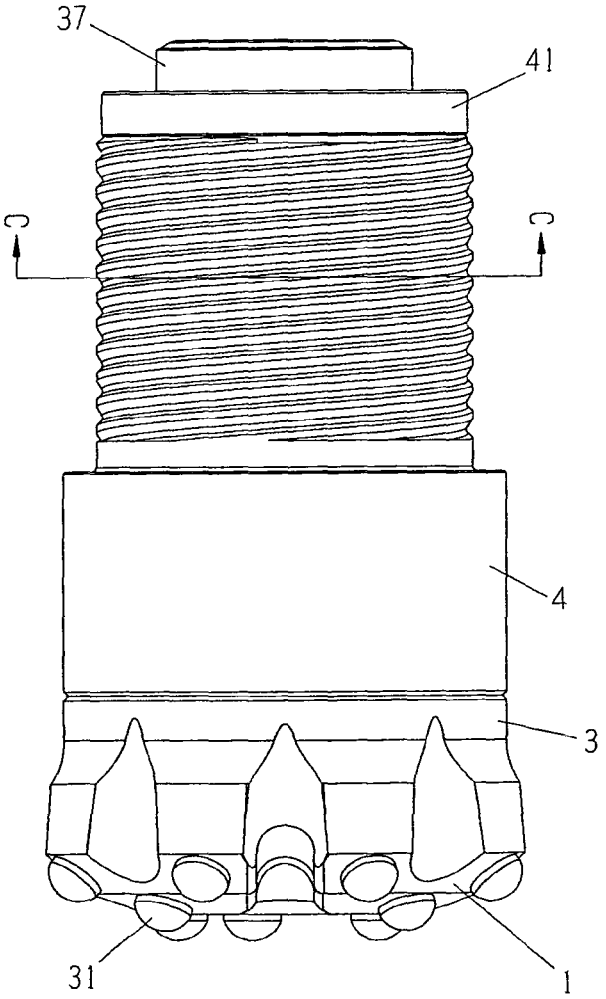
FIG. 4 is a side elevation of the assembled drill bit assembly of FIG. 1.

A down-the-hole hammer according to the invention comprises an external cylindrical outer wear sleeve. An inner cylinder is mounted co-axially within the outer wear sleeve. A sliding piston is mounted for reciprocating movement within the inner cylinder and the outer wear sleeve, to strike a hammer bit 1 located at the forward end of the outer wear sleeve to exercise a percussive force to the drill bit. Rotational forces are transferred from the rotating outer wear sleeve by means of a chuck 4. The wear sleeve is threadably connected to a drill string which is connected to a rotation motor on a drilling rig at the surface. Two embodiments of a down-the-hole hammer having a bit coupling system in accordance with the invention will now be described with reference to the drawings.

Referring particularly to FIGS. 1 to 8, the head portion 3 of the bit assembly comprises the percussion bit 1 which is provided with tungsten carbide inserts 31, in a well-known manner. The bit head portion 3 is formed with an axially extending stub shank 32. The stub shank 32 is formed with a lower splined portion 33, provided with a plurality of axially extending splines 36, an upper annular retaining shoulder portion 37 and an intermediate portion 50. The intermediate portion 50 is not provided with splines. Rotational torque is applied to the bit head portion 3 through the chuck 4. The hollow cylindrical chuck 4 is machined internally to provide a plurality of axially extending internal splines 35 on its internal wall which engage with the splines 36 of the shank 32 to transmit rotational drive from the chuck 4 to the drill bit. An upper part of the chuck 4 is externally screw threaded. The chuck 4 is also provided with an external annular shoulder 38, which acts as a stop when the chuck 4 is screwed into the wear sleeve.

Figure 5:
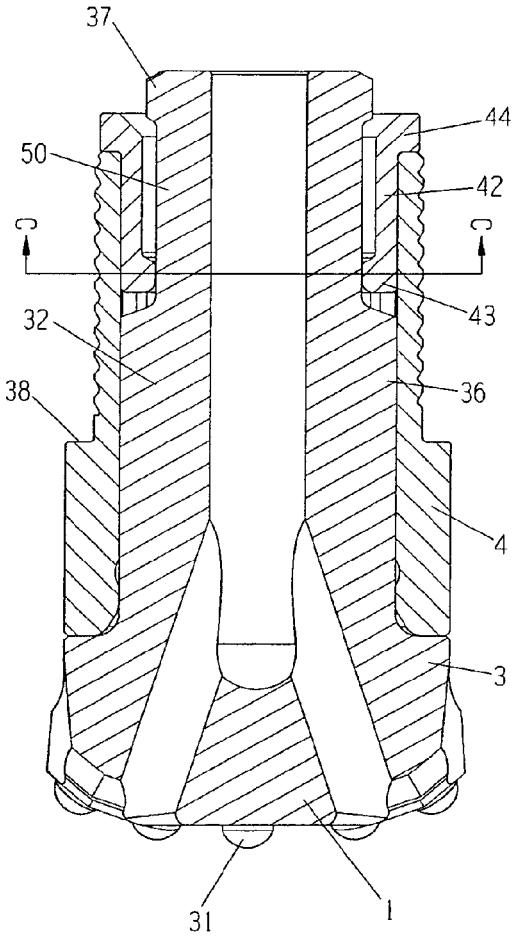
FIG. 5 is a sectional view of the assembled down-the-hole hammer of FIG. 4 showing the bit in the strike position.
Figure 6:
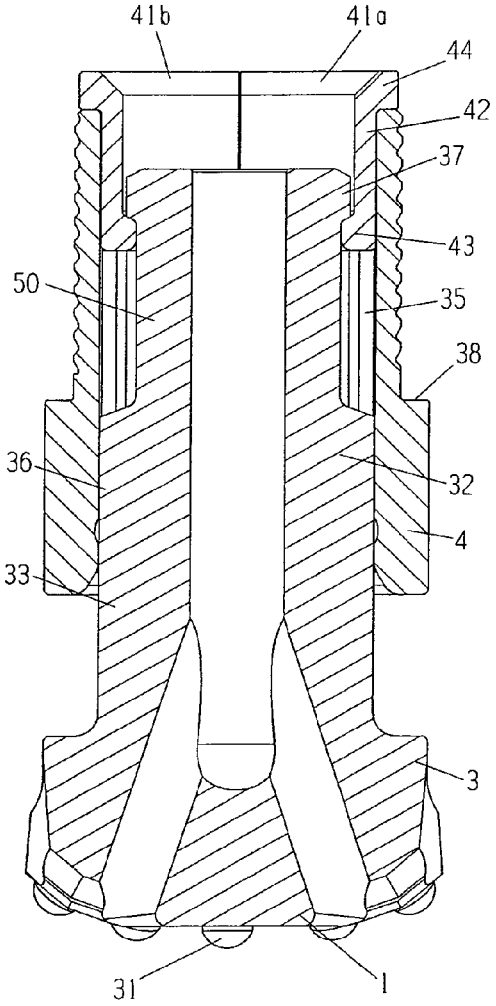
FIG. 6 is a sectional view of the assembled drill bit assembly of FIG. 4 showing the bit in the off-bottom (extended) position.
Figure 7:
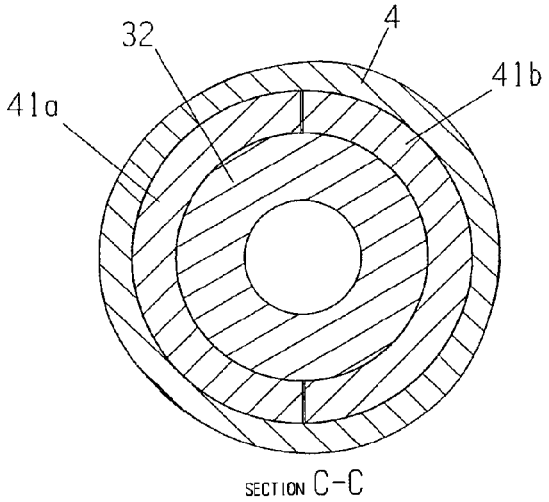
FIG. 7 is a sectional view of the assembled drill bit assembly of FIG. 4, taken along line CC.
Figure 8:
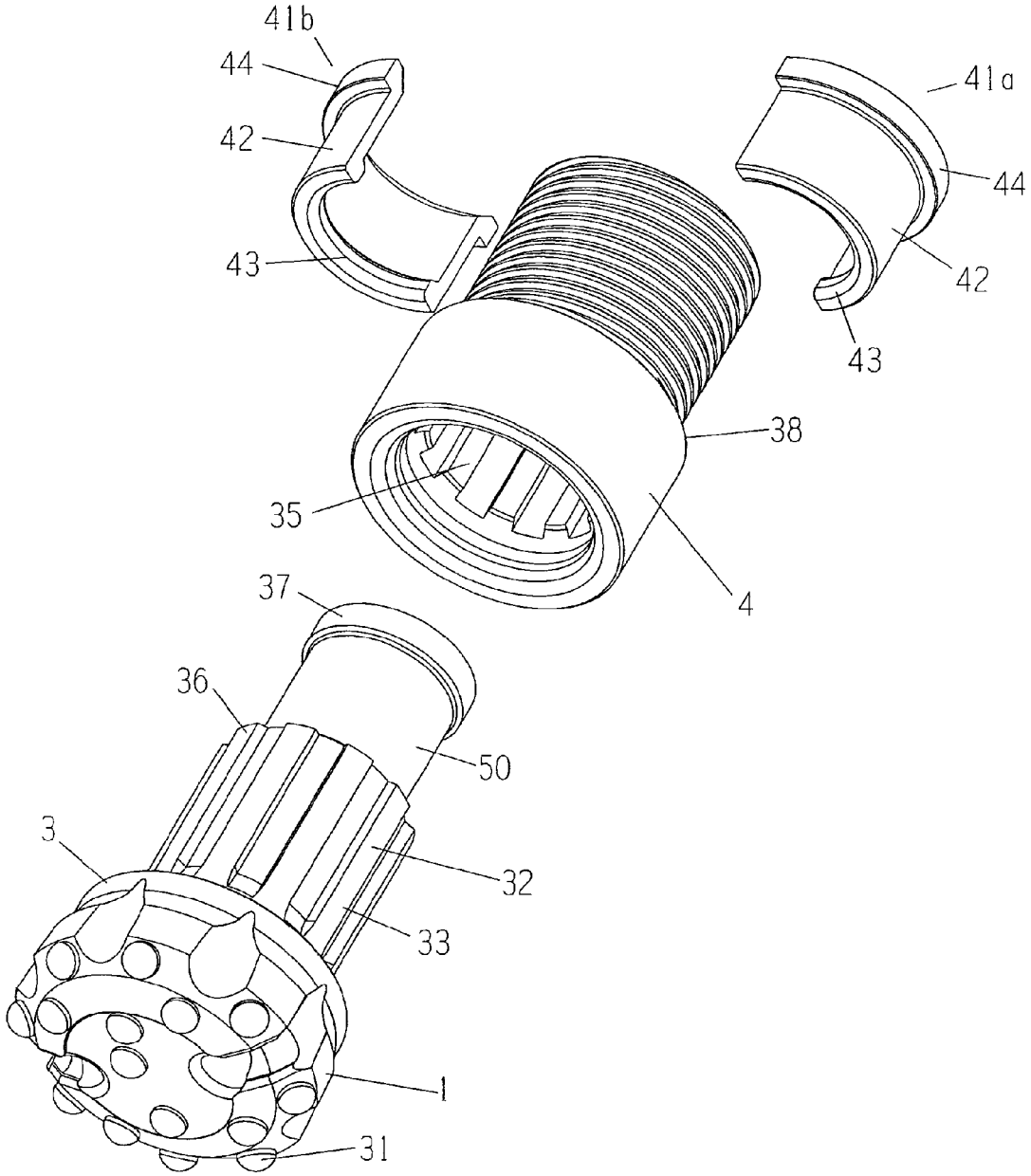
FIG. 8 is an exploded isometric view of the drill bit assembly of FIGS. 1 to 7.
Figure 9:
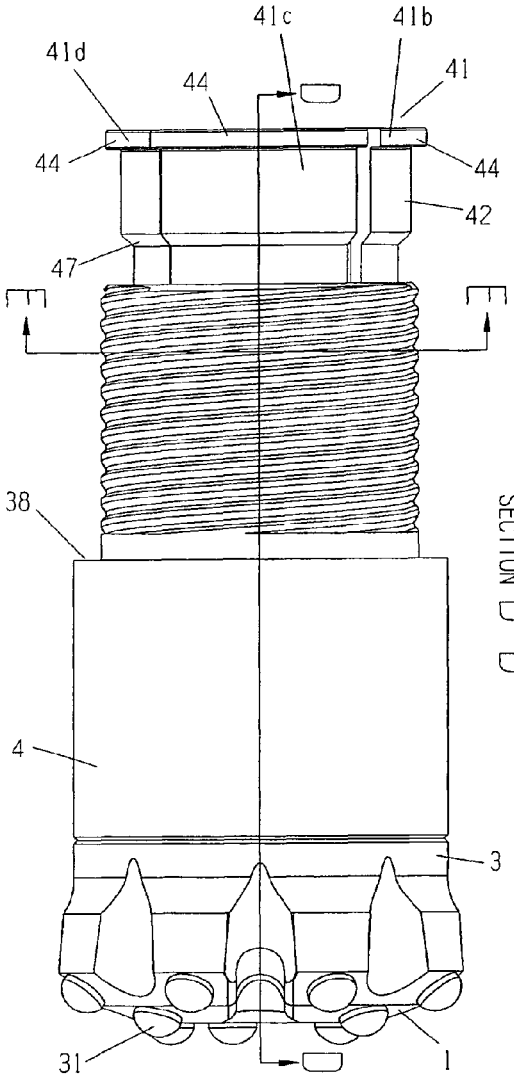
FIG. 9 is a side elevation of a drill bit assembly of a down-the-hole hammer according to a second embodiment of the invention, in a pre-assembled position.
Figure 10:
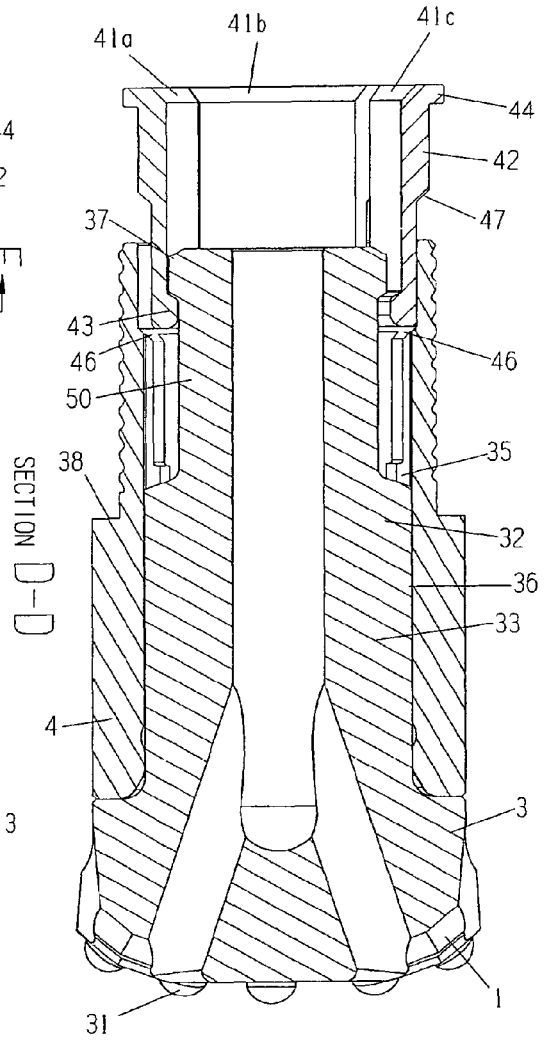
FIG. 10 is a sectional view of the drill bit assembly of FIG. 9, taken along line DD.
Figure 11:
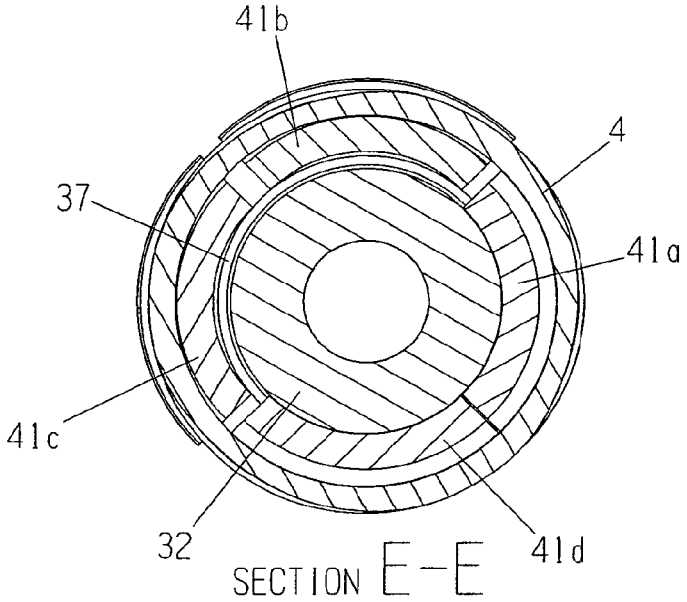
FIG. 11 is a sectional view of the drill bit assembly of FIG. 9, taken along line EE.
Figure 12:
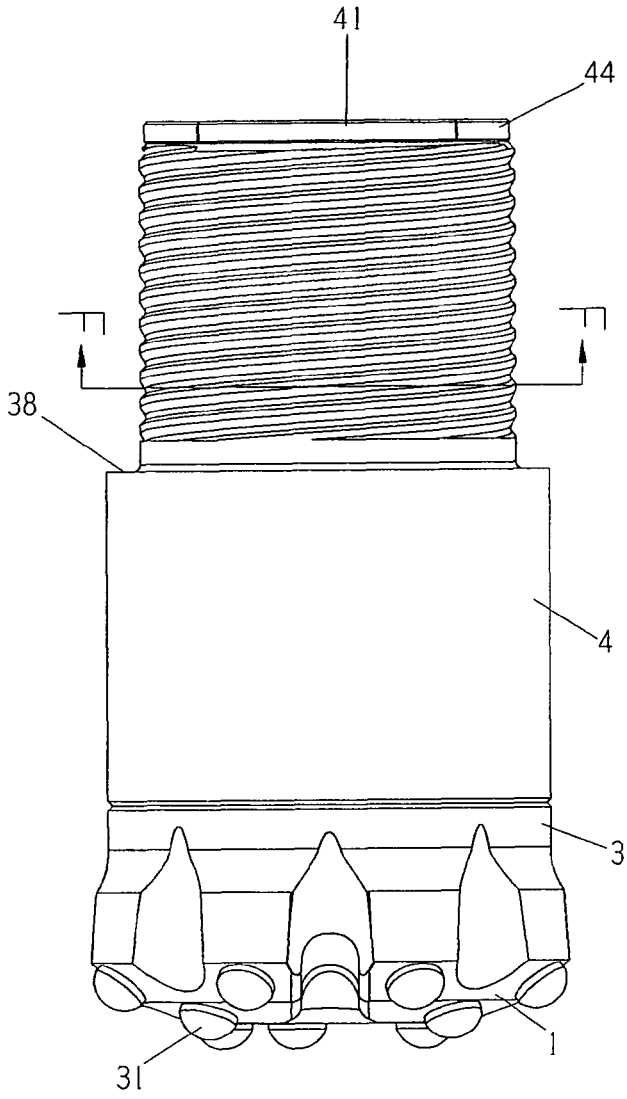
FIG. 12 is a side elevation of the assembled drill bit assembly of FIG. 9.
Figure 13:
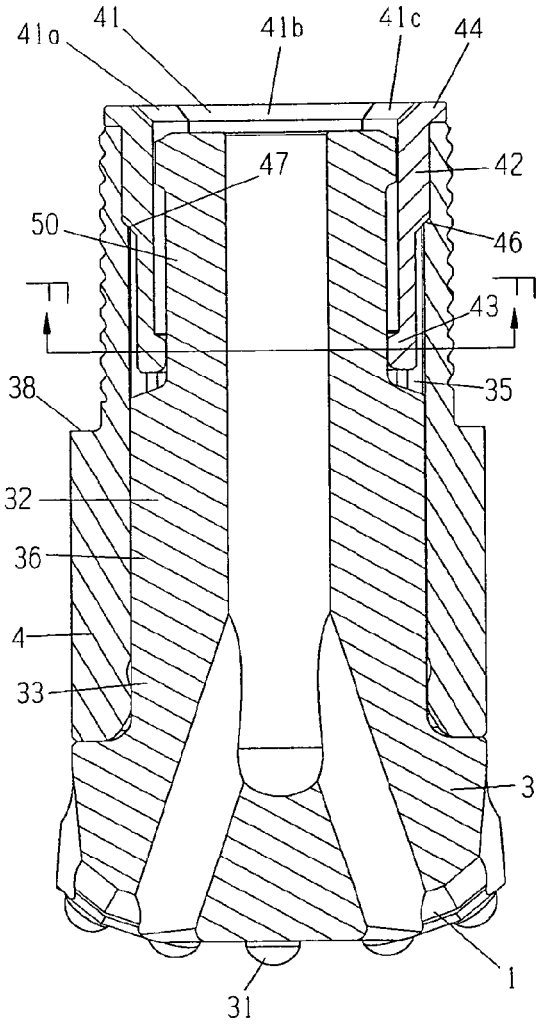
FIG. 13 is a sectional view of the assembled drill bit assembly of FIG. 12 showing the bit in the strike position.
Figure 14:
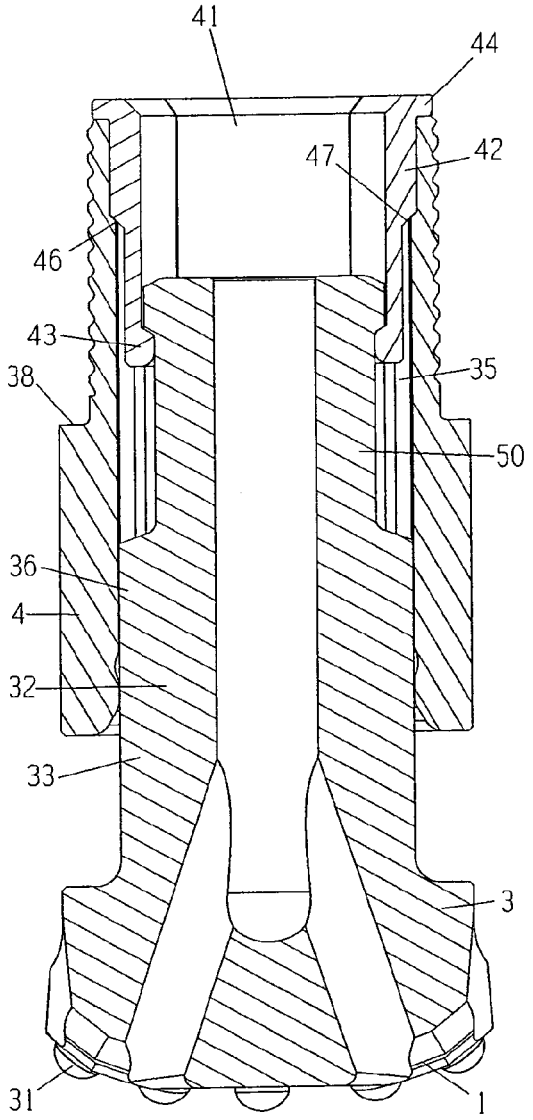
FIG. 14 is a sectional view of the assembled drill bit assembly of FIG. 12 showing the bit in the off-bottom (extended) position.
Figure 15:
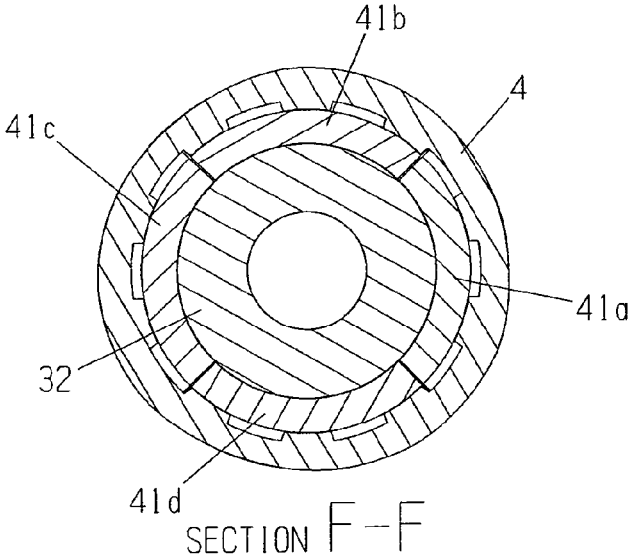
FIG. 15 is a sectional view of the assembled drill bit assembly of FIG. 12, taken along line FF.
Figure 16:
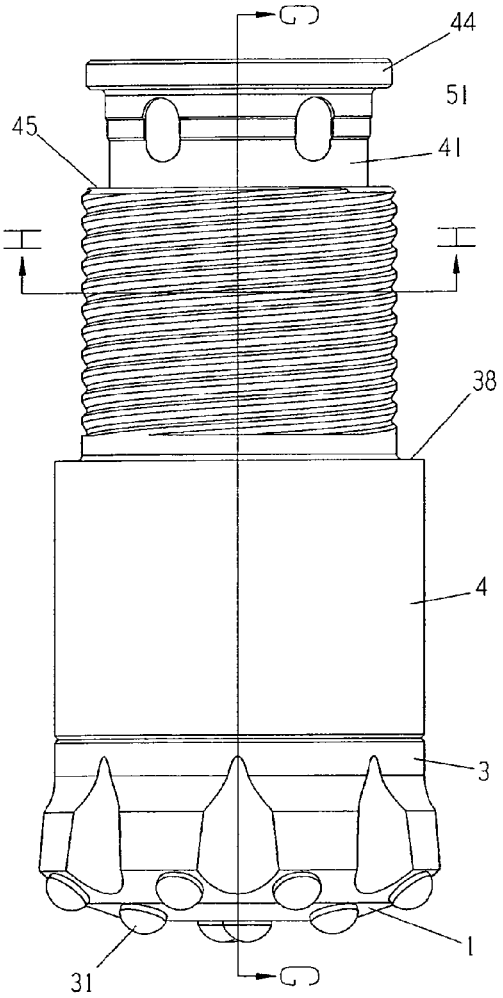
FIG. 16 is a side elevation view of a drill bit assembly of a down-the-hole hammer according to a second embodiment of the invention, in a pre-assembled position.
Figure 17:
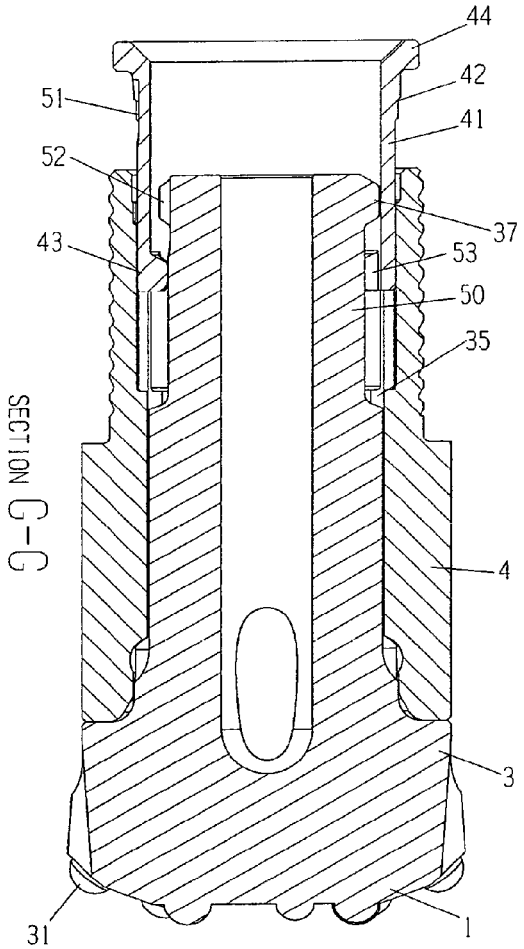
FIG. 17 is a sectional view of the drill bit assembly of FIG. 16, taken along line GG.
Figure 18:
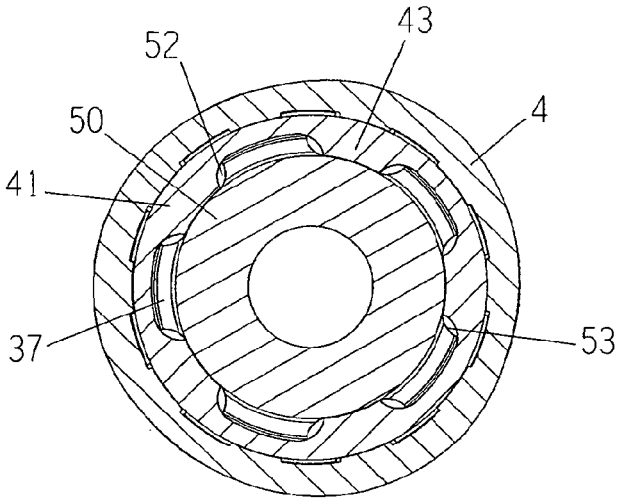
FIG. 18 is a sectional view of the drill bit assembly of FIG. 16, taken along line HH.

The assembly further comprises a bit retaining ring 41. As shown in FIGS. 2, 3, 6, 7 and 8, the ring 41 is formed in two-half annular parts 41*a*, 41*b* for ease of assembly. As shown in FIGS. 5 and 6, when the down-the-hole hammer is assembled, a lower portion 42 of the ring 41 is disposed within the chuck. The lower end of the ring 41 is formed with an inwardly directed abutment or shoulder 43. The bit retaining ring 41 is additionally provided with an outwardly directed abutment or shoulder 44 at an upper end thereof. In the assembled bit assembly, the inwardly directed abutment 43 engages with the retaining shoulder 37 on the stub shank 32 to retain the stub shank in the drill bit assembly. The chuck 4 is screwed into the lower end of the wear sleeve so that shoulder 44 of the retaining ring 41 is held in place between the upper end 45 of the chuck 4 and either an internal shoulder in the wear sleeve or a shoulder provided by assembled components within said wear sleeve. In addition, the screw-threaded engagement of the chuck 4 with the wear sleeve enables rotational torque to be transmitted from the wear sleeve through the chuck 4 to the bit 1.

A reciprocating piston is mounted for reciprocating movement within the inner cylinder and the outer wear sleeve to strike the top face of shoulder 37 to impart a percussive force to the bit. The splines 35 of the chuck 4 slideably engage with the complementary splines 36 on the shank 32 so that the head portion 3 is moved axially relatively to the chuck during the percussive action. As shown most clearly in FIG. 6, when the bit 3 is in the extended position, the outwardly directed abutment 43 on the lower end of the bit retaining ring 41, which is disposed within the chuck 4, engages the retaining shoulder 37, to retain the stub shank in the drill bit assembly.

A second embodiment of the invention is shown in FIGS. 9 to 15. In this embodiment, the length of the lower extension portion of the chuck, which protects the outer wear sleeve from excessive wear, is increased as compared with the first embodiment described above. In order to provide an upper screw thread portion of the chuck having a sufficient length, the overall length of the chuck 4 must be increased accordingly. However, the length of the bit shank remains the same. Thus, the length of the bit retaining ring must be increased, so that the point of retention of the bit may be provided at an appropriate distance from the lower end of the chuck.

In this embodiment, the hollow chuck 4 is provided with an internal counterbore, so that the internal bore of the chuck has an increased diameter at an upper end thereof. The diameter of the internal bore of the chuck is tapered to provide an internal wedging (cam) surface 46 at an upper end of the chuck 4. The retaining ring 41 has an increased diameter at an upper end thereof and a tapered shoulder 47, corresponding in shape to the wedging (cam) surface 46, is provided at an intermediate portion thereof. In this embodiment, the ring 41 comprises four part-annular segments, as shown most clearly in FIGS. 9 and 10. The tapered surface 46 of the chuck 4 and the shoulder 47 on the bit retaining ring co-operate to ease insertion of the ring into the chuck, as the tapered surface 46 has a wedging or swaging effect on the ring 41.

When the chuck 4 is screwed into the wear sleeve, shoulder 44 of the retaining ring is held in place between the upper end 45 of the chuck 4 and an internal shoulder provided in the wear sleeve and shoulder 47 engages with surface 46 to hold the retaining ring in the assembly.

In an alternative embodiment to that shown in FIGS. 9 to 15, the abutment 44 on the retaining ring 41 may be omitted, so that the retaining ring 41 is held in the chuck solely by means of the engagement between the taper 47 on the retaining ring 41 and the tapered surface 46 of the chuck 4.

A third embodiment of the invention is shown in FIGS. 16 to 23. As before, the head portion 3 of the bit assembly comprises the percussion bit 1 which is provided with tungsten carbide inserts 31, in a well-known manner. The bit head portion 3 is formed with an axially extending stub shank 32. The stub shank 32 is formed with a lower splined portion 33, provided with a plurality of axially extending splines 36, an upper annular retaining shoulder portion 37 and an intermediate portion 50. The intermediate portion 50 is not provided with splines. The upper annular retaining shoulder portion comprises a plurality of outwardly directed projections 37. In the embodiment shown, five projections 37 are provided, evenly spaced around the circumference of the bit.

Grooves 52 are provided between the projections 37. Rotational torque is applied to the bit head portion 3 through the chuck 4. The hollow cylindrical chuck 4 is machined internally to provide a plurality of axially extending internal splines 35 on its internal wall which engage with the splines 36 of the shank 32 to transmit rotational drive from the chuck 4 to the drill bit. An upper part of the chuck 4 is externally screw threaded. The chuck 4 is also provided with an external annular shoulder 38, which acts as a stop when the chuck 4 is screwed into the wear sleeve.

Figure 19:
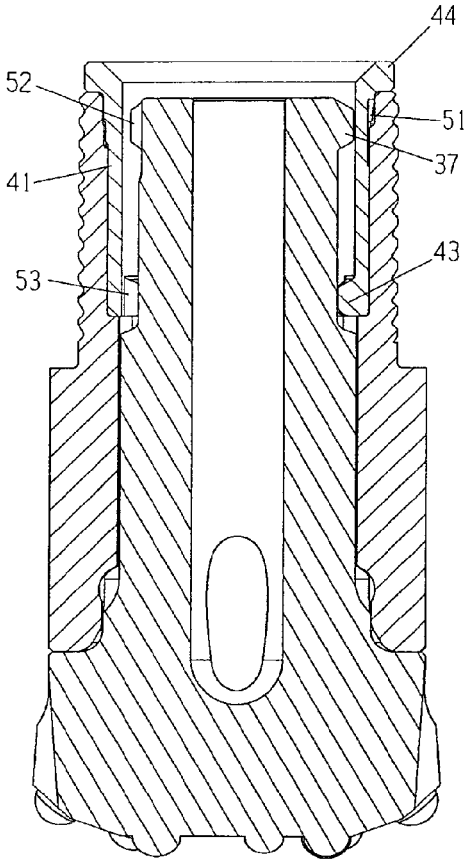
FIG. 19 is a sectional view of the assembled drill bit assembly of FIG. 16 showing the bit in the strike position.
Figure 20:
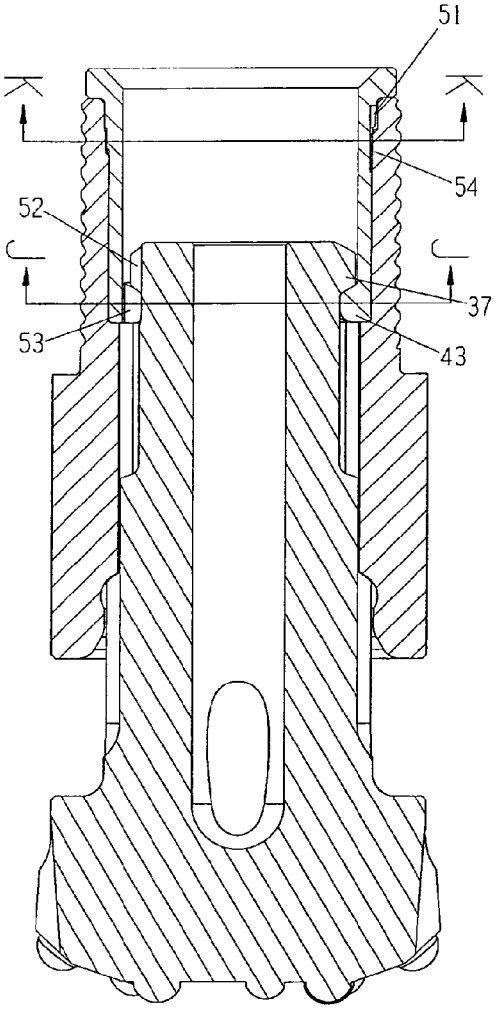
FIG. 20 is a sectional view of the assembled drill bit assembly of FIG. 16 showing the bit in the off-bottom (extended) position.
Figure 21:
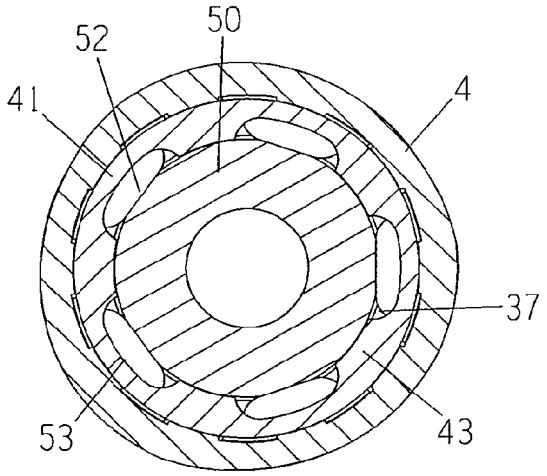
FIG. 21 is a sectional view of the assembled drill bit assembly of FIG. 20, taken along line JJ.
Figure 22:
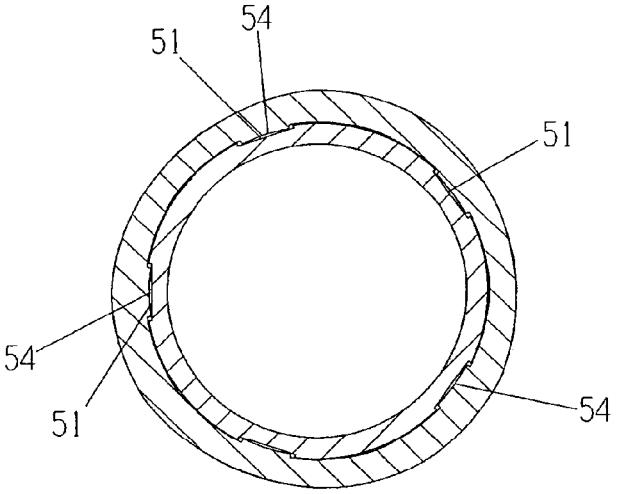
FIG. 22 is a sectional view of the assembled drill bit assembly of FIG. 20, taken along line KK.
Figure 23:
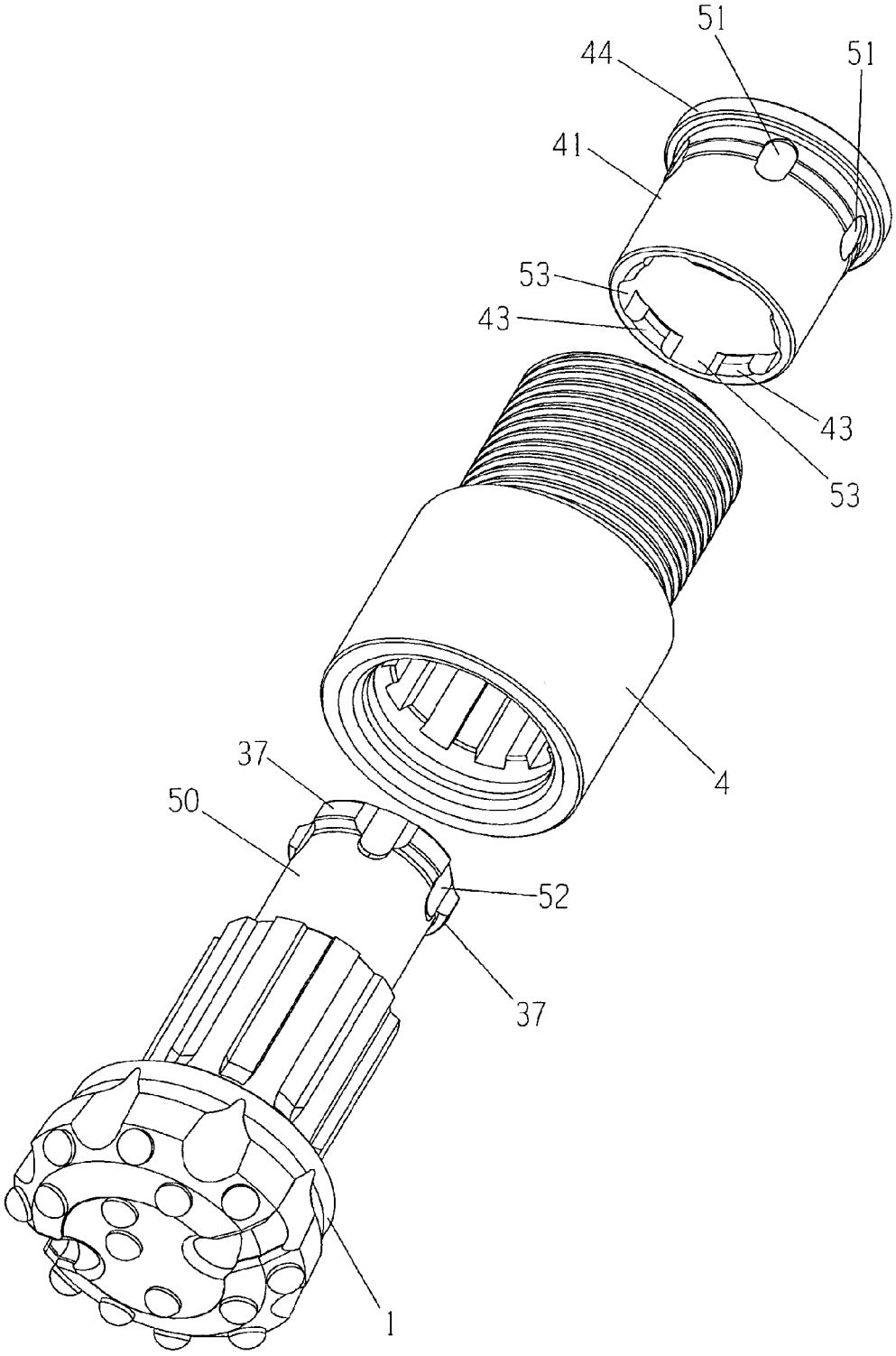
FIG. 23 is an exploded isometric view of the drill bit assembly of FIGS. 16 to 21.

The assembly further comprises a bit retaining ring 41. In this embodiment, the ring 41 is formed in a single piece. As shown in FIGS. 19 and 20, when the down-the-hole hammer is assembled, a lower portion 42 of the ring 41 is disposed within the chuck. The lower end of the ring 41 is formed with a plurality of inwardly directed projections or abutments 43 around its inner circumference. In the embodiment shown, five individual projections are provided, evenly spaced around the circumference of the ring 41. Grooves 53 are provided between the projections 43. The bit retaining ring 41 is additionally provided with an outwardly directed abutment or shoulder 44 at an upper end thereof.

The assembly is assembled by aligning the grooves 52 on the bit with the projections 43 on the retaining ring (and the grooves 53 on the retaining ring with the projections 37 on the bit) so that the pieces may be slid into position. Once the projections 43 on the ring have been slid past the shoulder portion 37 of the bit, the ring and the bit are rotated relative to one another, so that the projections 43 may engage with the retaining projections 37 on the stub shank 32 to retain the stub shank in the drill bit assembly. In the embodiment shown, the ring 41 and the bit 1 are preferably rotated by about 36° relative to one another. The retaining ring and the bit are then slid into engagement with the chuck 4. The ring 41 is prevented from rotating relative to the chuck 4 by means of grooves 51 provided at an upper end of the ring mating with locating lugs 54 provided in the bore of the chuck. The chuck 4 is screwed into the lower end of the wear sleeve so that shoulder 44 of the retaining ring 41 is held in place between the upper end 45 of the chuck 4 and either an internal shoulder in the wear sleeve or a shoulder provided by assembled components within said wear sleeve. In addition, the screw-threaded engagement of the chuck 4 with the wear sleeve enables rotational torque to be transmitted from the wear sleeve through the chuck 4 to the bit 1.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A drill bit assembly for fluid-operated percussion drill tools comprising:

a percussion bit having a head portion formed with an axially extending stub shank;

axially extending splines on the stub shank slideably engageable with complementary splines formed on a drive chuck whereby rotational drive from the chuck may be transmitted to the stub shank;

bit retaining means adapted for engagement with complementary retaining means on the stub shank to retain the stub shank in the drill bit assembly; and engagement means on the chuck adapted for connecting the chuck to a drive means of the fluid-operated percussion drill tool;

wherein the bit retaining means comprises a bit retaining ring, and the complementary retaining means comprises a retaining shoulder on the stub shank, the bit retaining ring arranged to engage the retaining shoulder to retain the stub shank in the drill bit assembly;

wherein the bit retaining ring further comprises a shoulder for engagement with an upper end of the chuck, wherein the shoulder is an outward taper arranged to engage with a counterbore in the chuck to hold the bit retaining ring in place in the assembly; and wherein a portion of the bit retaining ring adapted to engage the retaining shoulder to retain the stub shank in the drill bit assembly is disposed within the chuck.

2. A drill bit assembly as claimed in claim 1, wherein a lower portion of the bit retaining ring is disposed within the chuck.

3. A drill bit assembly as claimed in claim 2, wherein the portion of the bit retaining ring disposed within the chuck is formed with an abutment which engages with the retaining shoulder on the stub shank to retain the stub shank in the drill bit assembly.

4. A drill bit assembly as claimed in claim 3, wherein the abutment is an inwardly directed abutment.

5. A drill bit assembly as claimed in claim 1, wherein the retaining shoulder is disposed within the chuck when the bit is in the extended position.

6. A drill bit assembly as claimed in claim 5, wherein the retaining shoulder is provided at an upper end of the stub shank so that the upper end of the stub shank is disposed within the chuck when the bit is in the extended position.

7. A drill bit assembly as claimed in claim 1, wherein the bit retaining ring comprises a plurality of inwardly directed abutments around the circumference of the bit retaining ring and the bit is provided with a corresponding plurality of retaining shoulders, wherein each abutment engages with a corresponding retaining shoulder on the stub shank to retain the stub shank in the drill bit assembly.

8. A drill bit assembly as claimed in claim 7, wherein the retaining ring is provided with means for engagement with a corresponding locating means provided on the chuck to prevent rotational movement of the retaining ring relative to the chuck.

9. A drill bit assembly as claimed in claim 8, wherein the means comprises a groove provided at an upper end of the retaining ring for engagement with a corresponding locating lug provided internally of the chuck to prevent rotational movement of the retaining ring relative to the chuck.

10. A drill bit assembly as claimed in claim 1, wherein the shoulder is an outwardly directed shoulder.

11. A drill bit assembly as claimed in claim 1, wherein the shoulder is an outwardly directed abutment provided at an upper end of the retaining ring and disposed above the chuck to hold the retaining ring in place in the assembly.

12. A drill bit assembly as claimed in claim 1, wherein the bit retaining ring is formed as a plurality of segments for ease of assembly.

13. A down-the-hole hammer comprising:

an external cylindrical outer wear sleeve, and a sliding piston mounted for reciprocating movement within the outer wear sleeve to strike a percussion bit of a drill bit assembly located at the forward end of the outer wear sleeve, wherein the drill bit assembly comprises:

the percussion bit having a head portion formed with an axially extending stub shank;

axially extending splines on the stub shank slideably engageable with complementary splines formed on a drive chuck whereby rotational drive from the chuck may be transmitted to the stub shank;

bit retaining means adapted for engagement with complementary retaining means on the stub shank to retain the stub shank in the drill bit assembly; and engagement means on the chuck adapted for connecting the chuck to a drive means of the fluid-operated percussion drill tool;

wherein the bit retaining means comprises a bit retaining ring, and the complementary retaining means comprises a retaining shoulder on the stub shank, wherein the bit retaining ring is arranged to engage the retaining shoulder to retain the stub shank in the drill bit assembly;

wherein the bit retaining ring further comprises a shoulder for engagement with an upper end of the chuck, wherein the shoulder is an outward taper arranged to engage with a counterbore in the chuck to hold the bit retaining ring in place in the assembly; and wherein a portion of the bit retaining ring adapted to engage the retaining shoulder to retain the stub shank in the drill bit assembly is disposed within the chuck.

14. A down-the-hole hammer as claimed in claim 13, wherein the hammer is a reverse circulation down-the-hole hammer.

* * * * *